US007862967B2

(12) United States Patent
Wu et al.

(10) Patent No.: US 7,862,967 B2
(45) Date of Patent: Jan. 4, 2011

(54) PHOTOCONDUCTORS

(75) Inventors: Jin Wu, Webster, NY (US); Markus R. Silvestri, Fairport, NY (US); Kent J. Evans, Lima, NY (US); Daniel V. Levy, Rochester, NY (US); Michael A. Morgan, Fairport, NY (US); M. John Hinckel, Rochester, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 863 days.

(21) Appl. No.: 11/803,476

(22) Filed: May 15, 2007

(65) Prior Publication Data

US 2008/0286669 A1 Nov. 20, 2008

(51) Int. Cl.
*G03G 5/00* (2006.01)

(52) U.S. Cl. ..... 430/57.3; 430/59.4; 430/59.5

(58) Field of Classification Search ..... 430/57.3, 430/59.4, 59.5
See application file for complete search history.

(56) References Cited

U.S. PATENT DOCUMENTS

| | | | | |
|---|---|---|---|---|
| 4,265,990 | A | 5/1981 | Stolka et al. | |
| 4,921,769 | A | 5/1990 | Yuh et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,090,511 | A * | 7/2000 | Yang et al. | 430/57.2 |
| 6,348,290 | B1 * | 2/2002 | Yokota | 430/57.3 |
| 6,376,141 | B1 * | 4/2002 | Mishra et al. | 430/57.3 |
| 6,913,863 | B2 | 7/2005 | Wu et al. | |
| 2001/0001057 | A1 * | 5/2001 | Melnyk et al. | 430/57.3 |
| 2003/0224268 | A1 * | 12/2003 | Ikuno et al. | 430/57.3 |
| 2006/0105254 | A1 | 5/2006 | Wu et al. | |

OTHER PUBLICATIONS

Jin Wu et al., U.S. Appl. No. 11/472,766 on Titanyl Phthalocyanine Photoconductors, filed Jun. 22, 2006.

* cited by examiner

*Primary Examiner*—Mark A Chapman
(74) *Attorney, Agent, or Firm*—Oliff & Berridge, PLC

(57) ABSTRACT

A photoconductor that includes a supporting substrate, a first photogenerating layer, a second photogenerating layer and at least one charge transport layer. The first photogenerating layer contains, for example, a phthalocyanine pigment, and the second photogenerating layer contains a different phthalocyanine pigment than the first photogenerating layer phthalocyanine.

22 Claims, No Drawings

PHOTOCONDUCTORS

CROSS REFERENCE TO RELATED APPLICATIONS

U.S. application Ser. No. 11/472,766, now U.S. Pat. No. 7,485,398, filed Jun. 22, 2006 on Titanyl Phthalocyanine Photoconductors by Jin Wu et al., the disclosure of which is totally incorporated herein by reference in its entirety.

High photosensitivity titanyl phthalocyanines are illustrated in copending U.S. application Ser. No. 10/992,500, U.S. Publication No. 20060105254, the disclosure of which is totally incorporated herein by reference. These titanyl phthalocyanines and other similar high sensitivity, and more specifically, high photosensitivity titanyl Type V phthalocyanines can be selected for the first photogenerating layer, and hydroxygallium phthalocyanines, such as Type V, can be selected for the second photogenerating layer for the photoconductors of the present disclosure.

BACKGROUND

This disclosure is generally directed to drum and layered imaging members, photoreceptors, photoconductors, and the like. More specifically, the present disclosure is directed to multilayered flexible or belt imaging members or devices comprised of an optional supporting medium like a substrate, a first photogenerating layer, a second photogenerating layer, and a charge transport layer, inclusive of a plurality of charge transports layers, such as a first charge transport layer and a second charge transport layer, an optional adhesive layer, an optional hole blocking, or undercoat layer, an optional overcoating layer, and wherein at least one of the charge transport layers contains at least one charge transport component, a polymer, or resin binder. The first photogenerating layer is in embodiments in contact with the supporting substrate and the second photogenerating layer, that is the first photogenerating layer can be situated between the supporting substrate and the second photogenerating layer, or the second photogenerating layer can be situated between the supporting substrate and the first photogenerating layer. More specifically, the first photogenerating layer is comprised of a phthalocyanine, such as a high sensitivity titanyl phthalocyanine Type V, generated, for example, by the processes as illustrated in copending application U.S. application Ser. No. 10/992,500, U.S. Publication No. 20060105254, the disclosure of which is totally incorporated herein by reference. The second photogenerating layer, which can be situated between the charge transport layer and the first photogenerating layer, or where the second photogenerating layer can be situated between the supporting substrate and the first photogenerating layer, which first layer is situated between the charge transport layer and the second photogenerating layer, can be comprised of a different phthalocyanine than is present in the first photogenerating layer, and yet more specifically, where the second photogenerating pigment can be a hydroxygallium phthalocyanine.

The photoconductors illustrated herein in embodiments possess minimal undesirable ghosting characteristics, and developed xerographic images of excellent quality. Additionally, in embodiments the photoconductors disclosed herein possess excellent and in a number of instances low $V_r$ (residual potential), and allow the substantial prevention of $V_r$ cycle up when appropriate; high stable sensitivity; low acceptable image ghosting characteristics; and desirable toner cleanability.

More specifically, there is illustrated herein in embodiments the incorporation into the first and second photogenerating layer dissimilar photogenerating pigments, such as a suitable phthalocyanine photogenerating pigment like a number of titanyl phthalocyanines, especially titanyl phthalocyanine Type V, a dihydroxygallium phthalocyanine, and at least one hole transport component layer thereover either the first photogenerating layer or the second photogenerating layer, permitting, for example, minimum ghosting characteristics in the developed images, and where the photosensitivity thereof is from about 10 to about 50 percent higher than that of a similar photoconductor containing a single layer with a photogenerating pigment of a hydroxygallium phthalocyanine Type V pigment.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure.

The photoconductors disclosed herein are in embodiments sensitive in the wavelength region of, for example, from about 400 to about 900 nanometers, and in particular from about 500 to about 850 nanometers, thus diode lasers can be selected as the light source. Moreover, the photoconductors disclosed herein are in embodiments useful in high resolution color xerographic applications, particularly high-speed color copying and printing processes, and wherein the outputs thereof possess minimal ghosting characteristics or improved ghosting characteristics as compared, for example, to a similar photoconductor with a single photogenerating layer containing a phthalocyanine.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and more specifically about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

In U.S. Pat. No. 6,376,141, the disclosure of which is totally incorporated herein by reference, there are disclosed photoconductors with dual photogenerating layers.

Sensitivity is a valuable electrical characteristic of electrophotographic imaging members or photoconductors. A first aspect of sensitivity is spectral sensitivity, which refers to sensitivity as a function of wavelength. An increase in spectral sensitivity implies an appearance of sensitivity at a wavelength in which previously no sensitivity was detected. The second aspect of sensitivity, broadband sensitivity, is a change of sensitivity, for example an increase at a particular wavelength previously exhibiting sensitivity, or a general increase of sensitivity encompassing all wavelengths previously exhibiting sensitivity. This second aspect of sensitivity may also be considered as change of sensitivity, encompassing all wavelengths, with a broadband (white) light exposure. A problem encountered in the manufacturing of photoconductors is maintaining consistent spectral and broadband sensitivity from batch to batch.

Typically, flexible photoconductor belts are fabricated by depositing the various layers of photoactive coatings onto long webs that are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise, and thereafter transversely cut into predetermined lengths to form photoreceptor sheets of precise dimensions that are eventually welded into belts. The web length in a coating run may be many thousands of feet long, and the coating run may take more than an hour for each layer.

A number of titanyl phthalocyanines, or oxytitanium phthalocyanines, are suitable photogenerating pigments known to absorb near infrared light around 800 nanometers, and may exhibit improved sensitivity compared to a number of other photogenerating pigments. Generally, titanyl phthalocyanine is known to have five main crystal forms known as Types I, II, III, X, IV, and a recently generated Y and V. For example, U.S. Pat. Nos. 5,189,155 and 5,189,156, the entire disclosures of which are incorporated herein by reference, disclose a number of methods for obtaining various polymorphs of titanyl phthalocyanine. U.S. Pat. No. 5,153,094, the entire disclosure of which is incorporated herein by reference, relates to the preparation of titanyl phthalocyanine polymorphs including Types I, II, and III polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine-based photoreceptor having high sensitivity to near infrared light, it is believed of value to control not only the purity and chemical structure of the pigment, as is generally the situation with organic photoconductors, but also to prepare the pigment in a certain crystal modification. Consequently, it is still desirable to provide a photoconductor where the titanyl phthalocyanine is generated by a process that will provide high sensitivity titanyl phthalocyanines.

SUMMARY

Disclosed are photoconductors with many of the advantages illustrated herein, such as extended lifetimes of service of, for example, in excess of about 3,000,000 imaging cycles; rapid charge transfer to thereby improve print quality caused by temperature variation in proximity to the photoconductor; excellent electrical characteristics, for example high sensitivity; stable electrical properties; low image ghosting; resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photo-induced Discharge Curve), and the like.

Also disclosed are layered photoconductive imaging members, which are responsive to near infrared radiation of from about 700 to about 900 nanometers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

Aspects of the present disclosure relate to a photoconductor containing an optional supporting substrate, first and second photogenerating layers, and at least one charge transport layer comprised of at least one charge transport component wherein the at least one charge transport component is comprised of aryl amine molecules of the formula

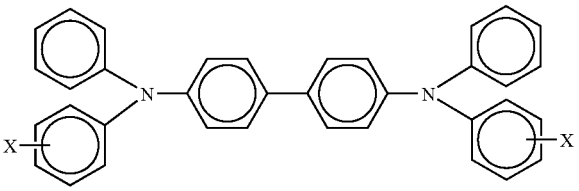

wherein X is a suitable substituent like alkyl, alkoxy, aryl, a halogen, or mixtures thereof, and wherein the first or second photogenerating layer contains a phthalocyanine pigment, such as a titanyl phthalocyanine prepared, for example, by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene and a second photogenerating layer that includes a different phthalocyanine photogenerating pigment or pigments than the first photogenerating layer like, for example, a hydroxygallium phthalocyanine; a photoconductor comprising a supporting substrate, a first photogenerating layer, a second photogenerating layer, and at least one charge transport layer, and wherein the first photogenerating layer includes a high photosensitivity pigment, which high is, for example, from about −400 to about −650 $Vcm^2/erg$, and the second photogenerating layer includes a photogenerating pigment with a photosensitivity lower than that of said first photogenerating pigment where photosensitivity refers, for example, to the initial slope of the PIDC curve when the photoconductor is charged to −500 volts and the charge transport layer or layers are about 30 microns in thickness; a photoconductor comprised in sequence of a substrate, a first and second photogenerating layer thereover, and a charge transport layer containing a charge transport component comprised of amines of the formula

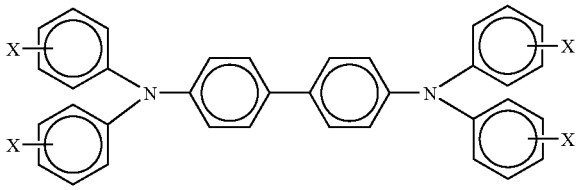

wherein X is a suitable hydrocarbon like alkyl, alkoxy, aryl, and substituted derivatives thereof; a halogen, or mixtures thereof, and especially those substituents selected from the group consisting of Cl and $CH_3$; and/or molecules of the following formulas

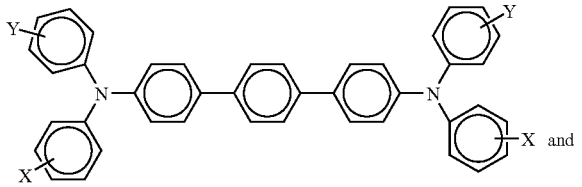

and

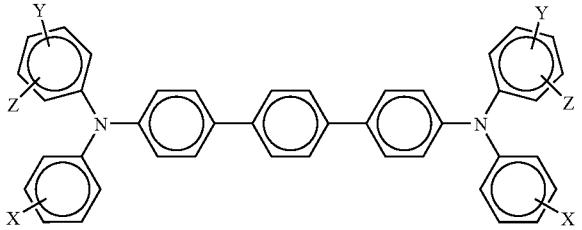

wherein X, Y and Z are a suitable substituent like a hydrocarbon, such as independently alkyl, alkoxy, or aryl; a halogen, or mixtures thereof, and wherein at least one of Y or Z is present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments. At least one charge transport refers, for example, to 1, from 1 to about 7, from 1 to about 4, and from 1 to about 2.

Also disclosed is a photoconductive imaging member comprised of a supporting substrate, a first photogenerating layer thereover, a second photogenerating deposited on the first photogenerating layer and thereover the photogenerating layer at least one charge transport layer, such as from 2 to about 8 layers, from 2 to about 4 layers, one layer, two layers, and the like, and in embodiments an overcoating layer; a photoconductive member with a first and second photogenerating layer, each of a thickness of from about 0.05 to about 10 microns; at least one transport layer, each of a thickness of from about 5 to about 100 microns; a member wherein each of the photogenerating layers contains a photogenerating pigment present in an amount of from about 5 to about 95 weight percent; a member wherein the thickness of each of the photogenerating layers is from about 0.1 to about 4 microns; a member wherein the photogenerating layer contains a polymer binder the same as or similar to the charge transport layer binder; a member wherein each of the photogenerating layer binders are present in an amount of from about 5 to about 95 percent by weight, and wherein the total of all layer components is about 100 percent; a photoconductor wherein the first photogenerating layer component is Type V titanyl phthalocyanine that absorbs light of a wavelength of from about 370 to about 950 nanometers; a photoconductive member wherein the supporting substrate is comprised of a conductive substrate comprised of a metal; an imaging member wherein the conductive substrate is aluminum, aluminized polyethylene terephthalate or titanized polyethylene terephthalate; a photoconductor wherein the photogenerating resinous binder is selected from the group consisting of polyesters, polyvinyl butyrals, polycarbonates, polystyrene-b-polyvinyl pyridine, and polyvinyl formulas, and the charge transport layers comprises hole transport molecules

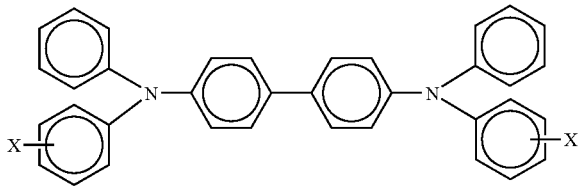

wherein the X substituent, which can be located in the para or meta positions, is selected from the group consisting of alkyl, alkoxy, substituted alkyl, substituted alkoxy, and halogen; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein the first photogenerating layer contains Type V, and the second photogenerating layer contains hydroxygallium phthalocyanine Type V, and the charge transport layer comprises

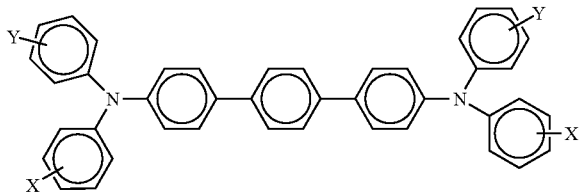

wherein X and Y are independently alkyl, alkoxy, aryl, substituted alkyl, substituted alkoxy, substituted aryl, a halogen such as fluoride, chloride, bromide or iodide, or mixtures thereof; an imaging member wherein alkyl and alkoxy contain from about 1 to about 12 carbon atoms; a photoconductive imaging member wherein for each charge transport layer there is selected in a suitable effective amount an aryl terphenyl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, other known terphenyls, and mixtures thereof; a photoconductive member wherein the charge transport layer is situated between the substrate and the first and second photogenerating layers; a member wherein the photogenerating layer is of a thickness of from about 0.1 to about 50 microns; a member wherein the photogenerating component amount for the first and second photogenerating layers is from about 20 weight percent to about 90 weight percent, and wherein the photogenerating pigment is dispersed in from about 10 weight percent to about 80 weight percent of a polymer binder; a member wherein the thickness of the photogenerating layer is from about 0.2 to about 12 microns; a member wherein the photogenerating and charge transport layer components are contained in a polymer binder; a member wherein the binder is present in an amount of from about 55 to about 95 percent by weight, and wherein the total of the layer components is about 100 percent; an imaging member with a blocking layer contained as a coating on a substrate, and an adhesive layer coated on the blocking layer; and a color imaging method, which comprises generating an electrostatic latent image on the imaging member, developing the latent image, transferring, and fixing the developed electrostatic image to a suitable substrate; a photoconductor comprising a supporting substrate, a first photogenerating layer, a second photogenerating layer, and at least one charge transport layer, and wherein the first photogenerating layer contains a suitable phthalocyanine pigment, and the second photogenerating layer contains a dissimilar phthalocyanine pigment than the first phthalocyanine photogenerating layer pigment; a photoconductor comprised in sequence of a substrate, a first photogenerating layer thereover, a second photogenerating layer contained on the first photogenerating layer and a charge transport layer, and wherein the first photogenerating layer includes a phthalocyanine pigment, and the second photogenerating layer includes a different phthalocyanine pigment than the first photogenerating layer; a photoconductor comprising a supporting substrate, a first photogenerating layer, a second photogenerating layer, and at least one charge transport layer, and wherein the first photogenerating layer includes a high photosensitivity pigment, which high is from about −400 to about −650 $Vcm^2/erg$, and the second photogenerating layer includes a photogenerating pigment with a photosensitivity lower than that of the first photogenerating pigment.

In embodiments, the first photogenerating layer contains a titanyl phthalocyanine, such as Type V titanyl phthalocyanine, prepared by dissolving a Type I titanyl phthalocyanine in a solution comprising a trihaloacetic acid and an alkylene halide; adding the resulting mixture to a solution comprising an alcohol and an alkylene halide thereby precipitating a Type Y titanyl phthalocyanine; and contacting the Type Y titanyl phthalocyanine with a monohalobenzene. The second photogenerating layer contains a pigment such as a hydroxygallium phthalocyanine Type V. Moreover, in embodiments there are disclosed photoconductors with a first photogenerating layer that includes a hydroxygallium phthalocyanine Type V component, and a second photogenerating layer that includes a titanyl phthalocyanine Type V component, or an ultra high photosensitivity photogenerating pigment such as known benzyl perylenes.

With further respect to the titanyl phthalocyanines like Type V selected for the photogenerating layer, such phthalocyanine exhibits a crystal phase that is distinguishable from other known titanyl phthalocyanine polymorphs, and is prepared by converting a Type I titanyl phthalocyanine to a Type V titanyl phthalocyanine pigment. The process includes converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide.

The processes illustrated herein further provide a titanyl phthalocyanine having a crystal phase distinguishable from other known titanyl phthalocyanines. The titanyl phthalocyanine Type V prepared by the process according to the present disclosure is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

A number of Type I titanyl phthalocyanines may be selected for the generation of the Type V titanyl phthalocyanine, such as the Type I prepared as illustrated in U.S. Pat. Nos. 5,153,094; 5,166,339; 5,189,155; and 5,189,156, each of the disclosures of which are totally incorporated herein by reference.

More specifically, a Type I titanyl phthalocyanine may be prepared, in embodiments, by the reaction of $DI^3$ (1,3-diiminoisoindolene) and tetrabutoxide in the presence of 1-chloronaphthalene or tetrahydronaphthalene solvent, whereby there is obtained a crude Type I titanyl phthalocyanine, which is subsequently purified up to about a 99.5 percent purity by washing with, for example, dimethylformamide.

In another embodiment, for example, a Type I titanyl phthalocyanine can also be prepared by i) the addition of 1 part titanium tetrabutoxide to a stirred solution of from about 1 part to about 10 parts, and in embodiments about 4 parts of 1,3-diiminoisoindolene; ii) relatively slow application of heat using an appropriate sized heating mantle at a rate of about 1° per minute to about 10° per minute and, in embodiments, about 5° per minute until refluxing occurs at a temperature of about 130° C. to about 180° C. (all temperatures are in Centigrade unless otherwise indicated); iii) removal and collection of the resulting distillate, which was shown by NMR spectroscopy to be butyl alcohol, in a dropwise fashion using an appropriate apparatus, such as a Claisen Head condenser, until the temperature of the reactants reaches from 190° C. to about 230° C., and in embodiments, about 200° C.; iv) continued stirring at the reflux temperature for a period of about ½ hour to about 8 hours, and in embodiments, about 2 hours; v) cooling of the reactants to a temperature of about 130° C. to about 180° C., and in embodiments, about 160° C. by removal of the heat source; vi) filtration of the flask contents through, for example, an M-porosity (10 to 15 microns) sintered glass funnel, which was preheated using a solvent, which is capable of raising the temperature of the funnel to about 150° C., for example, boiling N,N-dimethylformamide in an amount sufficient to completely cover the bottom of the filter funnel so as to prevent blockage of said funnel; vii) washing the resulting purple solid by slurrying the solid in portions of boiling DMF either in the funnel or in a separate vessel in a ratio of about 1 to about 10, and more specifically, about 3 times the volume of the solid being washed until the hot filtrate became light blue in color; viii) cooling and then further washing the solid obtained to remove impurities by slurrying the solid in portions of N,N-dimethylformamide at room temperature, about 25° C.; ix) further washing the resulting solid of impurities by slurrying the solid in portions of an organic solvent, such as methanol, acetone, water, and the like, and in this embodiment, methanol, at room temperature (about 25° C.) approximately equivalent to about three times the volume of the solid being washed until the filtrate became light blue in color; x) oven drying the purple solid in the presence of a vacuum or in air at a temperature of from about 25° C. to about 200° C., and, in embodiments at about 70° C., for a period of from about 2 hours to about 48 hours, and in embodiments, for about 24 hours, thereby resulting in the isolation of a shiny purple solid, which was identified as being Type I titanyl phthalocyanine by its X-ray powder diffraction trace.

In still another embodiment, a Type I titanyl phthalocyanine may be prepared by (1) reacting a $DI^3$ with a titanium tetra alkoxide, such as, for example, titanium tetrabutoxide, at a temperature of about 195° C. for about two hours; (ii) filtering the contents of the reaction to obtain a resulting solid; (iii) washing the solid with dimethylformamide (DMF); (iv) washing with four percent ammonium hydroxide; (v) washing with deionized water; (vi) washing with methanol; (vii) reslurrying the washes and filtering; and (viii) drying at about 70° C. under vacuum to obtain a Type I titanyl phthalocyanine.

In a process embodiment for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one volume part to about 100 volume parts of the solvent, and the alkylene halide is present in an amount of from about one volume part to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine is dissolved by, for example, stirring in the solvent for about one hour at room temperature (about 25° C.). The Type I titanyl phthalocyanine may be dissolved in the solvent in either air or in an inert atmosphere (argon or nitrogen).

In embodiments, the Type I titanyl phthalocyanine is converted to an intermediate titanyl phthalocyanine form prior to conversion to the high sensitivity titanyl phthalocyanine pigment. "Intermediate" in embodiments refers, for example, that the Type Y titanyl phthalocyanine is a separate form prepared in the process prior to obtaining the final desired Type V titanyl phthalocyanine product. For example, to obtain the intermediate form, which is designated as a Type Y titanyl phthalocyanine, the dissolved Type I titanyl phthalocyanine is added to a quenching system comprising an alkyl alcohol, alkyl including, for example, carbon chain lengths of from about 1 to about 12 carbon atoms, and alkylene halides, such as an alkylene chloride. Adding the dissolved Type I titanyl phthalocyanine to the quenching system or quenching mixture causes the Type Y titanyl phthalocyanine to precipitate. Materials suitable as the alkyl alcohol component of the quenching system include, but are not limited to, methanol, ethanol, propanol, butanol, and the like. In embodiments, the alkylene chloride component of the quenching system comprises from about one to about six carbon atoms. In embodiments, the quenching system comprises methanol and methylene chloride. The quenching system comprises an alkyl alcohol to alkylene chloride ratio of from about 1/4 to about 4/1 (v/v). In other embodiments, the ratio of alkyl alcohol to alkylene chloride is from about 1/1 to about 3/1 (v/v). In an embodiment, the quenching system comprises methanol and methylene chloride in a ratio of about 1/1 (v/v). In another embodiment, the quenching system comprises methanol and methylene chloride in a ratio of about 3/1 (v/v). In embodiments, the dissolved Type I titanyl phthalocyanine is added to the quenching system at a rate of from about 1 milliliter/minute to about 100 milliliters/minute, and the quenching system is maintained at a temperature of from about 0° C. to about −25° C. during quenching. In a further embodiment, the quenching system is maintained at a temperature of from about 0° C. to about −25° C. for a period of from about 0.1 hour to about 8 hours after addition of the dissolved Type I titanyl phthalocyanine solution.

Following precipitation of the Type Y titanyl phthalocyanine, the precipitates may be washed with any suitable solution, including, for example, methanol, cold deionized water, hot deionized water, and the like. Generally, washing the precipitate will also be accompanied by filtration. A wet cake containing Type Y titanyl phthalocyanine and water is obtained with water content varying from about 30 to about 70 weight percent of the wet cake.

The Type V titanyl phthalocyanine is obtained by treating the obtained intermediate Type Y titanyl phthalocyanine with a halo, such as, for example, monochlorobenzene. The Type Y titanyl phthalocyanine wet cake may be redispersed in monochlorobenzene, filtered and oven-dried at a temperature of from about 60° C. to about 85° C. to provide the resultant Type V titanyl phthalocyanine. The monochlorobenzene treatment may occur over a period of about 1 hour to about 24 hours. In one embodiment, the monochlorobenzene treatment is accomplished for a period of about five hours.

A titanyl phthalocyanine obtained in accordance with processes of the present disclosure, which is designated as a Type V titanyl phthalocyanine, exhibits an X-ray powder diffraction spectrum distinguishable from other known titanyl phthalocyanine polymorphs. A Type V titanyl phthalocyanine obtained exhibits in embodiments an X-ray diffraction spectrum having four characteristic peaks at 9.0°, 9.6°, 24.0°, and 27.2°, and has a particle size diameter of from about 10 nanometers to about 500 nanometers. Particle size may be controlled or affected by the quenching rate when adding the dissolved Type I titanyl phthalocyanine to the quenching system and the composition of the quenching system.

The hydroxygallium phthalocyanines are known and can be prepared by the processes disclosed inclusive of the processes as illustrated in the relevant U.S. patents recited herein.

Examples of phthalocyanine photogenerating pigments in the first and second photogenerating layer can be selected from the group consisting of titanyl phthalocyanine (Types I, IV and V), hydroxygallium phthalocyanine (Types I and V), chlorogallium phthalocyanine (Types A, B and C), metal-free phthalocyanine, alkoxygallium phthalocyanine, zinc phthalocyanine, copper phthalocyanine, and the like, and mixtures thereof, where the phthalocyanine pigment in the first photogenerating layer is different from the phthalocyanine pigment present in the second photogenerating layer.

Generally, the thickness of the photogenerating layer depends on a number of factors, including for example, the thicknesses of the other layers, whether an anticurl, a hole blocking, and adhesive layer are present, and the number of and amount of components present in photogenerating layer. Accordingly, this layer can be of a thickness of, for example, from about 0.05 micron to about 30 microns, from about 0.1 to about 15 microns, and more specifically, from about 0.25 micron to about 2 microns when, for example, the photogenerating pigments are present in an amount of from about 30 to about 75 percent by volume. The maximum thickness of this layer in embodiments is dependent primarily upon factors, such as the photosensitivity desired, electrical properties to be obtained, and mechanical considerations. The photogenerating layer binder resin includes those polymers as disclosed in U.S. Pat. No. 3,121,006, the disclosure of which is totally incorporated herein by reference, and where the binder is present in various suitable amounts, for example from about 1 to about 70 weight percent, and more specifically, from about 10 to about 50 weight percent, and which resin may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, the first or second photogenerating layer may contain in addition to the high sensitivity titanyl phthalocyanine other known photogenerating pigments like metal phthalocyanines, metal free phthalocyanines, alkylhydroxyl gallium phthalocyanines, hydroxygallium phthalocyanines, and chlorogallium phthalocyanines.

Generally, in embodiments the photoconductor is comprised of the above photogenerating layer deposited on a supporting substrate, and which layer can be situated between the at least one charge transport layer and the substrate.

The thickness of the substrate layer may depend on a number of factors, including economical considerations, electrical characteristics, and the like, thus this layer may be of a substantial thickness, for example about 3,500 microns, such as from about 300 to about 2,000 microns, or of a minimum thickness, such as from about 150 to about 300 microns. In embodiments, the thickness of this layer is from about 75 microns to about 300 microns, or from about 100 microns to about 150 microns.

The substrate may be opaque or substantially transparent, and may comprise any suitable material inclusive of known materials with suitable mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of a substantial thickness of, for example, up to many centimeters or of a minimum thickness of less than a millimeter. Similarly, a flexible belt may be of a substantial thickness, for example about 250 micrometers, or of a minimum thickness of less than 50 micrometers, provided there are no adverse effects on the final electrophotographic device.

Illustrative examples of substrates are as illustrated herein, and can comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, or an anticurl layer, such as for example, polycarbonate materials commercially available as MAKROLON®.

Various resins can be used as electrically nonconducting materials, including, but not limited to, polyesters, polycarbonates, polyamides, polyurethanes, and the like. Examples of suitable substrate materials include, but are not limited to, a commercially available biaxially oriented polyester known as MYLAR™, available from E.I. DuPont de Nemours & Company, MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E.I. DuPont de Nemours & Company, polyethylene and polypropylene, available as MARLEX™ from Phillips Petroleum Company, polyphenylene sulfide, RYTON™, available from Phillips Petroleum Company, and polyimides, available as KAPTON™ from E.I. DuPont de Nemours & Company. The photoreceptor can also be coated on an insulating plastic drum, provided a conducting ground plane has previously been coated on its surface, as described above. Such substrates can either be seamed or seamless.

When a conductive substrate is employed, any suitable conductive material can be selected. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers, such as polyacetylene or its pyrolysis, and molecular doped products, charge transfer complexes, polyphenyl silane, and molecular doped products from polyphenyl silane. A conducting plastic drum can be used, as well as the preferred conducting metal drum made from a material such as aluminum.

A number of charge transport components, such as compounds and molecules, can be selected for the charge transport layer such as the materials disclosed herein. In embodiments, aryl amines are selected for the charge, especially hole transporting layer, which layer generally is of a thickness of from about 5 microns to about 75 microns, and more specifically, of a thickness of from about 10 microns to about 40 microns, include molecules of the following formula

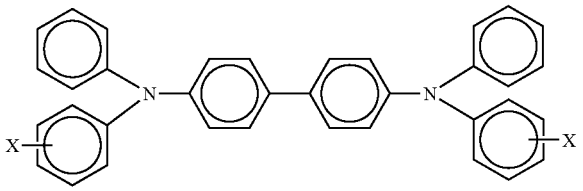

wherein X is at least one of alkyl, alkoxy, aryl, or a halogen, and especially those substituents selected from the group consisting of Cl and $CH_3$; and/or molecules of the following formula

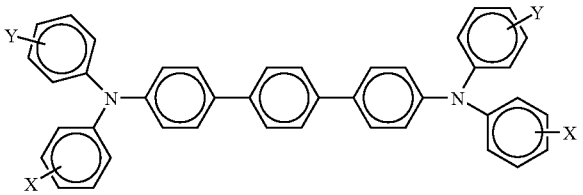

wherein X and Y are independently alkyl, alkoxy, aryl, a halogen, or mixtures thereof. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific charge transport components include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and the like. Other known charge transport layer molecules can be selected, reference for example U.S. Pat. Nos. 4,921,773 and 4,464,450, the disclosures of which are totally incorporated herein by reference.

The charge transport layer or layers, and more specifically, a first charge transport in contact with the photogenerating layer, and thereover a top or second charge transport overcoating layer may comprise the illustrated herein charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed" in embodiments refers, for example, to charge transporting molecules dispersed in the polymer, the small molecules being dispersed in the polymer on a molecular scale.

Examples of charge transporting molecules present, for example, in an amount of from about 30 to about 75 weight percent, and more specifically, from about 40 to about 55 weight percent, and yet more specifically, about 50 weight percent include, for example, known hole transport components; aryl amines such as N,N'-diphenyl-N,N'-bis(3-methylphenyl)-(1,1'-biphenyl)-4,4'-diamine, N,N'-diphenyl-N,N-bis(4-methylphenyl)-1,1'-biphenyl-4,4'-diamine, N,N'-diphenyl-N,N-bis(2-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, optionally mixtures thereof, and the like. The electrically active small molecule charge transporting compounds are dissolved or molecularly dispersed in electrically inactive polymeric film forming materials. A small molecule charge transporting compound that permits injection of holes into the photogenerating layer with high efficiency, and transports them across the charge transport layer with short transit times specifically includes, for example, N,N'-diphenyl-N,N'-bis(3-methylphenyl)-(1,1'-biphenyl)-4,4'-diamine, N,N'-diphenyl-N,N-bis(4-methylphenyl)-1,1'-biphenyl-4,4'-diamine, N,N'-diphenyl-N,N-bis(2-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, or N,N'-diphenyl-N,N'-bis(3-chlorophenyl)-[p-terphenyl]-4,4"-diamine. If desired, the charge transport material in the charge transport layer may comprise a polymeric charge transport material, or a combination of a small molecule charge transport material and a polymeric charge transport material.

The charge transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be maintained from about 2:1 to 200:1, and in some instances about 400:1. The charge transport layer is substantially nonabsorbing to visible light or radiation in the region of intended use, but is electrically "active" in that it allows the injection of photogenerated holes from the photoconductive layer, that is the photogenerating layer, and allows these holes to be transported through itself to selectively discharge a surface charge on the surface of the active layer.

The thickness of the continuous charge transport overcoat layer selected depends, for example, upon the abrasiveness of the charging (bias charging roll), cleaning (blade or web), development (brush), transfer (bias transfer roll), and the like in the system employed and can be up to about 10 micrometers. In embodiments, this thickness for each layer is from about 1 micrometer to about 5 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating layer of this disclosure should transport holes during imaging and should not have too high a free carrier concentration. Free carrier concentration in the overcoat increases the dark decay.

The overcoat layer or layers can comprise the same components as the charge transport layer wherein the weight ratio between the charge transporting small molecule, and the suitable electrically inactive resin binder is, for example, from about 0/100 to about 60/40, or from about 20/80 to about 40/60.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof. In embodiments, electrically inactive binders are comprised of polycarbonate resins with, for example, a molecular weight of from about 20,000 to about 100,000, and more specifically, with a molecular weight $M_w$ of from about 50,000 to about 100,000. Examples of polycarbonates are poly(4,4'-isopropylidene-diphenylene) carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyldiphenyl)carbonate (also referred to as bisphenol-C-polycarbonate), and the like.

The optional hole blocking or undercoat layer for the imaging members of the present disclosure can contain a number of components, including known hole blocking components, such as amino silanes, doped metal oxides, a metal oxide like titanium, chromium, zinc, tin, and the like; a mixture of phenolic compounds and a phenolic resin, or a mixture of two phenolic resins; and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylenediisopropylidene)bisphenol), S (4,4'-sulfonyldiphenol), Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical), formaldehyde polymers with ammonia, cresol and phenol, such as VARCUM® 29112 (available from OxyChem Company), formaldehyde polymers with 4,4'-(1-methylethylidene)bisphenol, such as VARCUM™ 29108 and 29116 (available from OxyChem Company), formaldehyde polymers with cresol and phenol, such as VARCUM® 29457 (available from OxyChem Company), DURITE® SD-423A, SD-422A (available from Borden Chemical), or formaldehyde polymers with phenol and p-tert-butylphenol, such as DURITE® ESD 556C (available from Border Chemical).

The hole blocking layer may be applied to the substrate. Any suitable and conventional blocking layer capable of forming an electronic barrier to holes between the adjacent photoconductive layer (or electrophotographic imaging layer) and the underlying conductive surface of the substrate may be selected.

In embodiments, a suitable known adhesive layer, usually situated between the hole blocking layer and the photogenerating layer, can be selected for the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As adhesive layer component examples, there can be selected various known substances inclusive of polyesters, copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425βL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents and each of the components/compounds/molecules, polymers, (components) for each of the substrate, charge transport, resin binders, hole blocking, and adhesive layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups and mixtures thereof. Also, the carbon chain lengths are intended to include all numbers between those disclosed or claimed or envisioned, thus from 1 to about 20 carbon atoms, and from 6 to about 42 carbon atoms includes 1, 2, 3, 4, 5, 6, 7, 8, 9, 10, 11, 12, 13, 14, 15 up to 42, or more. Similarly, the thickness of each of the layers, the examples of components in each of the layers, the amount ranges of each of the components disclosed and claimed is not exhaustive, and it is intended that the present disclosure and claims encompass other suitable parameters not disclosed, or that may be envisioned.

The following Examples are being submitted to illustrate embodiments of the present disclosure. These Examples are intended to be illustrative only and are not intended to limit the scope of the present disclosure. Also, parts and percentages are by weight, temperatures are in degrees Centigrade, and the layer thicknesses were measured with a permascope, unless otherwise indicated. Comparative Examples and data are also provided.

EXAMPLE I

Preparation of Type I Titanyl Phthalocyanine

A Type I titanyl phthalocyanine (TiOPc) was prepared as follows. To a 300 milliliter three-necked flask fitted with mechanical stirrer, condenser and thermometer maintained under an argon atmosphere were added 3.6 grams (0.025 mole) of 1,3-diiminoisoindoline, 9.6 grams (0.075 mole) of o-phthalonitrile, 75 milliliters (80 weight percent) of N-methyl pyrrolidone and 7.11 grams (0.025 mole) of titanium tetrapropoxide (all obtained from Aldrich Chemical Company except phthalonitrile which was obtained from BASF). The resulting mixture (20 weight percent of solids) was stirred and warmed to reflux (about 198° C.) for 2 hours. The resultant black suspension was cooled to about 150° C., and then was filtered by suction through a 350 milliliter, M-porosity sintered glass funnel, which had been preheated with boiling dimethyl formamide (DMF). The solid Type I TiOPc product resulting was washed with two 150 milliliter portions of boiling DMF, and the filtrate, initially black, became a light blue-green color. The solid was slurried in the funnel with 150 milliliters of boiling DMF, and the suspension was filtered. The resulting solid was washed in the funnel with 150 milliliters of DMF at 25° C., and then with 50 milliliters of methanol. The resultant shiny purple solid was dried at 70° C. overnight to yield 10.9 grams (76 percent) of pigment, which was identified as Type I TiOPc on the basis of its X-ray powder diffraction trace. Elemental analysis of the product indicated C, 66.54; H, 2.60; N, 20.31; and Ash ($TiO_2$), 13.76. TiOPc requires (theory): C, 66.67; H, 2.80; N, 19.44; and Ash, 13.86.

A Type I titanyl phthalocyanine can also be prepared in 1-chloronaphthalene as follows. A 250 milliliter three-necked flask fitted with mechanical stirrer, condenser and thermometer maintained under an atmosphere of argon was charged with 1,3-diiminoisoindolene (14.5 grams), titanium tetrabutoxide (8.5 grams), and 75 milliliters of 1-chloronaphthalene (ClNp). The mixture was stirred and warmed. At 140° C. the mixture turned dark green and began to reflux. At this time the vapor (which was identified as n-butanol by gas chromatography) was allowed to escape to the atmosphere until the reflux temperature reached 200° C. The reaction was maintained at this temperature for two hours then was cooled to 150° C. The product was filtered through a 150 milliliter M-porosity sintered glass funnel, which was preheated to approximately 150° C. with boiling DMF, and then washed thoroughly with three portions of 150 milliliters of boiling DMF, followed by washing with three portions of 150 milliliters of DMF at room temperature, and then three portions of 50 milliliters of methanol, thus providing 10.3 grams (72 percent yield) of a shiny purple pigment, which was identified as Type I TiOPc by X-ray powder diffraction (XRPD).

EXAMPLE II

Preparation of Type V Titanyl Phthalocyanine

Fifty grams of TiOPc Type I were dissolved in 300 milliliters of a trifluoroacetic acid/methylene chloride (1/4, volume/volume) mixture for 1 hour in a 500 milliliter Erlenmeyer flask with magnetic stirrer. At the same time, 2,600 milliliters of a methanol/methylene chloride (1/1, volume/volume) quenching mixture were cooled with a dry ice bath for 1 hour in a 3,000 milliliter beaker with a magnetic stirrer, and the final temperature of the mixture was about −25° C. The resulting TiOPc solution was transferred to a 500 milliliter addition funnel with a pressure-equalization arm, and added into the cold quenching mixture over a period of 30 minutes. The mixture obtained was then allowed to stir for an additional 30 minutes, and subsequently hose-vacuum filtered through a 2,000 milliliter Buchner funnel with fibrous glass frit of 4 μm to 8 μm in porosity. The pigment resulting was then well mixed with 1,500 milliliters of methanol in the funnel, and vacuum filtered. The pigment was then well mixed with 1,000 milliliters of hot water (>90° C.), and vacuum filtered in the funnel four times. The pigment was then well mixed with 1,500 milliliters of cold water, and vacuum filtered in the funnel. The final water filtrate was measured for conductivity, which was below 10 μS. The resulting wet cake contained approximately 50 weight percent of water. A small portion of the wet cake was dried at 65° C. under vacuum, and a blue pigment was obtained. A representative XRPD of this pigment after quenching with methanol/methylene chloride was identified by XRPD as Type Y titanyl phthalocyanine.

The remaining portion of the wet cake was redispersed in 700 grams of monochlorobenzene (MCB) in a 1,000 milliliter bottle and rolled for an hour. The dispersion was vacuum filtered through a 2,000 milliliter Buchner funnel with a fibrous glass frit of 4 μm to 8 μm in porosity over a period of two hours. The pigment was then well mixed with 1,500 milliliters of methanol, and filtered in the funnel twice. The final pigment was vacuum dried at 60° C. to 65° C. for two days. Approximately 45 grams of the pigment were obtained. The XRPD of the resulting pigment after the MCB conversion was designated as a Type V titanyl phthalocyanine. The Type V had an X-ray diffraction pattern having characteristic diffraction peaks at a Bragg angle of $2\Theta \pm 0.2°$ at about 9.0°, 9.6°, 24.0°, and 27.2°.

COMPARATIVE EXAMPLE 1

A photoconductor was prepared by providing a 0.02 micrometer thick titanium layer coated on a biaxially oriented polyethylene naphthalate substrate (KALEDEX™ 2000) having a thickness of 3.5 mils, and applying thereon, with a gravure applicator or an extrusion coater, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer, using a gravure applicator or an extrusion coater, and which adhesive contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A first photogenerating layer dispersion was prepared by introducing 0.45 gram of the known polycarbonate IUPILON 200™ (PCZ-200) weight average molecular weight of 20,000, available from Mitsubishi Gas Chemical Corporation, and 44.65 grams of tetrahydrofuran into a 4 ounce glass bottle. To this solution were added 2.4 grams of hydroxygallium phthalocyanine (HOGaPc, Type V) and 300 grams of ⅛ inch (3.2 millimeters) diameter stainless steel shot. The resulting mixture was then placed on a ball mill for 8 hours. Subsequently, 2.25 grams of PCZ-200 was dissolved in 46.1 grams of tetrahydrofuran, and added to the hydroxygallium phthalocyanine dispersion. The obtained slurry was then placed on a shaker for 10 minutes. The resulting dispersion was, thereafter, applied to the above adhesive interface with a Bird applicator to form a first hydroxygallium phthalocyanine Type V photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the (metal conductive layer for electrical contact) ground strip layer that was applied later. The photoconductor containing the first photogenerating layer was dried at 120° C. for 1 minute in a forced air oven to form a dry first photogenerating layer having a thickness of 0.4 micron.

The second photogenerating layer dispersion was prepared by repeating the above process for the first photogenerating layer, and subsequently the second photogenerating layer was coated on top of the first photogenerating layer, and which second layer had a dry thickness of 0.4 micron.

The second photogenerating layer was then overcoated with a charge transport layer prepared by introducing into an amber glass bottle in a weight ratio of 1:1 N,N'-diphenyl-N,N'-bis(3-methylphenyl)-1,1'-biphenyl-4,4'-diamine and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. The resulting solution was applied on the above second photogenerating layer to form a coating thereon that upon drying (120° C. for 1 minute) had a thickness of 29 microns. During this coating process the humidity was about 15 percent.

EXAMPLE III

A photoconductor was prepared by substantially repeating the process of Comparative Example 1. More specifically, the first photogenerating layer dispersion was prepared by introducing 0.45 gram of the known polycarbonate IUPILON 200™ (PCZ-200) weight average molecular weight of 20,000, available from Mitsubishi Gas Chemical Corporation, and 44.65 grams of monochlorobenzene into a 4 ounce glass bottle. To this solution were added 2.4 grams of titanyl phthalocyanine (TiOPc, Type V) and 300 grams of ⅛ inch (3.2 millimeter) diameter stainless steel shot. This mixture was then placed on a ball mill for 8 hours. Subsequently, 2.25 grams of PCZ-200 was dissolved in 46.1 grams of monochlorobenzene, and added to the titanyl phthalocyanine dispersion. The obtained slurry was then placed on a shaker for 10 minutes.

There was then deposited on the Type V titanyl phthalocyanine containing first photogenerating layer a second photogenerating layer comprised of hydroxygallium phthalocyanine Type V, and which second layer dispersion was prepared by repeating the above process for the second photogenerating layer dispersion of Comparative Example 1.

More specifically, the resulting above two dispersions were applied in sequence, the first layer being deposited on the adhesive layer, and then the second layer deposited on the first photogenerating layer with a Bird applicator to form a first and a second photogenerating layer, each having a wet thickness of 0.25 mil. A strip about 10 millimeters wide along one edge of the substrate web bearing the blocking layer and the adhesive layer was deliberately left uncoated by any of the photogenerating layers to facilitate adequate electrical contact by the ground strip layer that was applied later. The photoconductor containing the photogenerating layers was dried at 120° C. for 1 minute in a forced air oven to form a first and second dry photogenerating layer, each having a thickness of 0.4 micron.

EXAMPLE IV

A photoconductor was prepared by repeating the process of Example III except that the first photogenerating layer contained the hydroxygallium phthalocyanine Type V pigment, and the second photogenerating layer contained the titanyl phthalocyanine Type V pigment.

There was deposited on the adhesive layer the above first hydroxygallium phthalocyanine Type V photogenerating layer, and thereafter there was deposited on the first photogenerating layer the second titanyl phthalocyanine Type V containing photogenerating layer with a Bird applicator to form a first and a second photogenerating layer, each having a wet thickness of 0.25 mil. A strip about 10 millimeters wide along one edge of the substrate web bearing the blocking layer and the adhesive layer was deliberately left uncoated by any of the photogenerating layers to facilitate adequate electrical contact by the ground strip layer that was applied later. The photoconductor containing the two photogenerating layers was dried at 120° C. for 1 minute in a forced air oven to form a first and second dry photogenerating layer each having a thickness of 0.4 micron.

ELECTRICAL PROPERTY TESTING

The above prepared photoconductors of Comparative Example 1, Examples III and IV were tested in a scanner set to obtain photo-induced discharge cycles, sequenced at one charge-erase cycle followed by one charge-expose-erase cycle wherein the light intensity was incrementally increased with cycling to produce a series of photo-induced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner (the equipment for measuring the PIDC) selected was equipped with a scorotron set to a constant voltage charging at various surface potentials. The photoconductors were tested at surface potentials of 500 volts with the exposure light intensity incrementally increased by regulating a series of neutral density filters; the exposure light source was a 780 nanometer light emitting diode. The xerographic simulation was completed in an environmentally controlled light tight chamber at ambient conditions (40 percent relative humidity and 22° C.). The PIDC curves information is summarized in Table 1.

TABLE 1

| | V(0.8) (V) | V(1.6) (V) | V(4.0) (V) |
|---|---|---|---|
| Comparative Example 1 | 228 | 228 | 237 |
| Example III | 105 | 100 | 104 |
| Example IV | 58 | 55 | 58 |

The PIDC curve for the photoconductor of Example III, and more specifically, Example IV did not significantly differ from the PIDC curve of the Comparative Example 1 photoconductor. V(0.8), V(1.6) and V(4.0) represent the surface potential (in volts) of the photoconductors when the exposure was 0.8 ergs/cm$^2$, 1.6 ergs/cm$^2$ and 4.0 ergs/cm$^2$, respectively.

GHOSTING MEASUREMENT

When a photoconductor is selectively exposed to positive charges in a xerographic print engine, such as the Xerox Corporation iGEN®, it is observed that some of these charges enter the photoconductor and manifest themselves as a latent image in the next printing cycle. This print defect can cause a change in the lightness of the half tones, and is commonly referred to as a "ghost" that is generated in the previous printing cycle.

An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print if one switches to a larger paper format that covers the previous paper print free zone.

In the ghosting test, the photoconductors were electrically cycled to simulate continuous printing. At the end of every tenth cycle known, incremental positive charges were injected into the photoconductors tested. In the follow-on cycles the electrical response to these injected charges were measured and then translated into a rating scale.

The electrical response to the injected charges in the print engine and in the electrical test fixture evidenced a drop in the surface potential. This drop was calibrated to calorimetric values in the prints, and they in turn were calibrated to the ranking scale of an average rating of at least two observers. On this scale, 1 refers to no observable ghost and values of 7 refer to a very strong ghost. The functional dependence between the change in surface potential and the ghosting scale is slightly supra-linear, and may in first approximation be linearly scaled.

There was deposited ⅜ inch diameter, 150 Å thick, gold dots, using a sputterer, onto the transport layer of the photoconductors of Comparative Example 1, Examples III and IV. Then they were dark rested (in the absence of light) for at least two days at 22° C. and 50 percent RH to allow relaxation of the surfaces.

These electroded photoconductor devices (gold dot on charge transport layer surface) were then cycled in a test fixture that injected positive charge through the gold dots with the methodology described above. The change in surface potential was then determined for injected charges of 27 nC/cm$^2$ (nC=nano Coulomb=$10^{-9}$ Coulomb., the unit for charge). This value was selected to be a little larger than typically expected in the Xerox Corporation iGEN3® print engine to generate strong signals. Finally, the changes in the surface potentials were translated into ghost rankings by the aforementioned calibration curves. This method was repeated 4 times for each photoconductor, and then the averages were calculated. Typical standard deviation of the mean tested on numerous devices was about 0.35. The ghost ratings are reported in Table 2 with the Examples III and IV evidencing less ghosting as compared to the photoconductor of Comparative Example 1.

TABLE 2

| | Ghost Rating |
|---|---|
| Comparative Example 1 | 7.3 |
| Example III | 5.4 |
| Example IV | 5.6 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a first photogenerating layer, a second photogenerating layer, and a charge transport layer, and wherein the first photogenerating layer contains a Type V titanyl phthalocyanine pigment, and the second photogenerating layer contains a hydroxygallium phthalocyanine.

2. A photoconductor in accordance with claim 1 wherein said first photogenerating layer is situated between said substrate and said second photogenerating layer, and said hydroxygallium phthalocyanine is Type V hydroxygallium phthalocyanine.

3. A photoconductor in accordance with claim 2 wherein said substrate is an aluminum drum.

4. A photoconductor in accordance with claim 1 wherein said second photogenerating layer is situated between said substrate and said first photogenerating layer, and wherein said first photogenerating layer is in contact with and contiguous to said charge transport layer.

5. A photoconductor in accordance with claim 4 wherein said hydroxygallium phthalocyanine is hydroxygallium phthalocyanine Type V.

6. A photoconductor in accordance with claim 1 wherein the sequence is said first photogenerating layer deposited on said substrate, said second photogenerating layer deposited on said first photogenerating layer, and said charge transport layer deposited on said second photogenerating layer.

7. A photoconductor in accordance with claim 6 wherein one said charge transport layer is from 1 to about 4 layers.

8. A photoconductor in accordance with claim 6 wherein said charge transport layer is 1 or 2.

9. A photoconductor in accordance with claim 1 wherein the sequence is said second photogenerating layer deposited on said substrate, said first photogenerating layer deposited on said second photogenerating layer, and said charge transport layer deposited on said first photogenerating layer.

10. A photoconductor in accordance with claim 1 wherein said charge transport layer is from 1 to about 4 layers.

11. A photoconductor in accordance with claim 1 wherein said hydroxygallium phthalocyanine is hydroxygallium phthalocyanine Type V.

12. A photoconductor in accordance with claim 1 wherein said titanyl phthalocyanine Type V has an X-ray diffraction pattern having characteristic diffraction peaks at a Bragg angle 2Θ±0.2° at about 9.0°, 9.6°, 24.0°, and 27.2°.

13. A photoconductor in accordance with claim 1 wherein said titanyl phthalocyanine is prepared by dissolving a Type I titanyl phthalocyanine in a solution of trifluoroacetic acid and methylene chloride; precipitating therefrom a Type Y titanyl phthalocyanine by adding said solution of trifluoroacetic acid, methylene chloride and the Type I titanyl phthalocyanine to a solution of methanol and methylene chloride; washing said Type Y titanyl phthalocyanine; and converting the Type Y titanyl phthalocyanine to said Type V titanyl phthalocyanine by treating said Type Y titanyl phthalocyanine with monochlorobenzene.

14. A photoconductor in accordance with claim 1 wherein said charge transport layer is comprised of at least one of

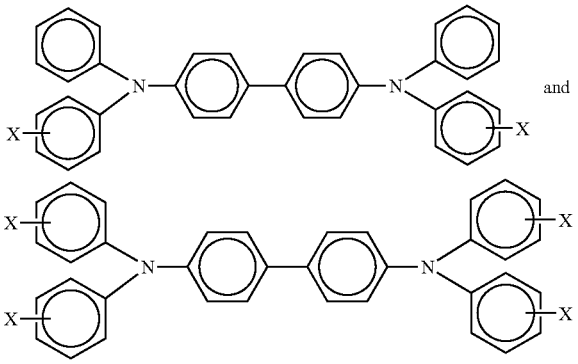

and wherein X is selected from the group consisting of at least one of alkyl, alkoxy, aryl, and halogen.

15. A photoconductor in accordance with claim 14 wherein said aryl amine is N,N'-diphenyl-N,N-bis(3-methylphenyl)-1,1'-biphenyl-4,4'-diamine.

16. A photoconductor in accordance with claim 1 wherein said charge transport layer comprises at least one of

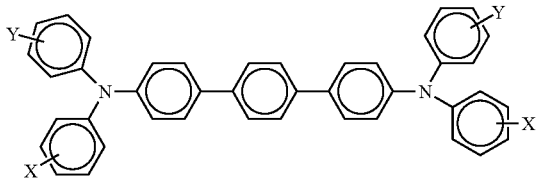

and

-continued

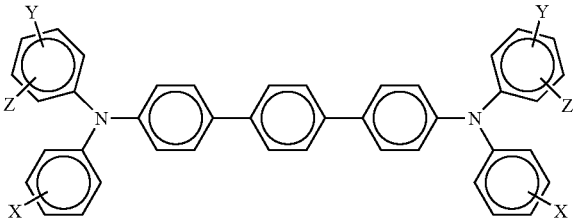

wherein each X, Y and Z is independently selected from the group consisting of alkyl, alkoxy, aryl, halogen; and mixtures thereof.

17. A photoconductor in accordance with claim 1 wherein said charge transport layer is comprised of at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

18. A photoconductor in accordance with claim 1 wherein said charge transport layer includes a hole transport molecule that is selected from the group consisting of N,N'-diphenyl-N,N-bis(3-methylphenyl)-1,1'-biphenyl-4,4'-diamine, N,N'-diphenyl-N,N-bis(4-methylphenyl)-1,1'-biphenyl-4,4'-diamine, N,N'-diphenyl-N,N-bis(2-methylphenyl)-1,1'-biphenyl-4,4'-diamine, and mixtures thereof.

19. A photoconductor in accordance with claim 1 further including a hole blocking layer, and an adhesive layer.

20. A photoconductor in accordance with claim 1 wherein the substrate is comprised of a polymer.

21. A photoconductor in accordance with claim 1 wherein the substrate is comprised of a conductive component.

22. A photoconductor in accordance with claim 1 wherein said substrate is an aluminum drum.

* * * * *